US009326558B2

(12) United States Patent
Martins et al.

(10) Patent No.: US 9,326,558 B2
(45) Date of Patent: May 3, 2016

(54) FALSE EYELASH DISPENSER

(71) Applicant: ELC Management LLC, Melville, NY (US)

(72) Inventors: Agostinho Martins, New Hyde Park, NY (US); Charles Aaron Curtiss, Norwalk, CT (US)

(73) Assignee: ELC Management, LLC, Melville, NY (US)

( * ) Notice: Subject to any disclaimer, the term of this patent is extended or adjusted under 35 U.S.C. 154(b) by 0 days.

(21) Appl. No.: 14/206,212

(22) Filed: Mar. 12, 2014

(65) Prior Publication Data

US 2014/0263392 A1 Sep. 18, 2014

Related U.S. Application Data

(60) Provisional application No. 61/791,606, filed on Mar. 15, 2013.

(51) Int. Cl.

| | |
|---|---|
| ***B65H 5/28*** | (2006.01) |
| ***G07F 11/68*** | (2006.01) |
| ***A41G 5/02*** | (2006.01) |
| ***B65D 83/00*** | (2006.01) |
| ***B65D 83/08*** | (2006.01) |
| *B65D 35/22* | (2006.01) |

(52) U.S. Cl.

CPC ..... *A41G 5/02* (2013.01); *B65D 83/0083* (2013.01); *B65D 83/0864* (2013.01); *B65D 35/22* (2013.01); *B65D 83/0888* (2013.01)

(58) Field of Classification Search

CPC .. B65D 83/0083; B65D 83/0864; A41G 5/02; A45D 44/00

USPC ..... 221/71; 225/57; 132/216

See application file for complete search history.

(56) References Cited

U.S. PATENT DOCUMENTS

| | | | | | |
|---|---|---|---|---|---|
| 2,587,928 | A * | 3/1952 | Tuck | B65D 83/0472 | 206/445 |
| 2,667,176 | A * | 1/1954 | Wassmer | A41G 5/02 | 132/216 |
| 3,386,619 | A * | 6/1968 | Douglas | B65D 83/00 | 118/506 |
| 3,461,886 | A * | 8/1969 | Bau | A41G 5/02 | 132/216 |
| 3,969,181 | A * | 7/1976 | Seabold | B65H 37/007 | 15/104.94 |
| 4,090,642 | A * | 5/1978 | Baker | B65D 75/327 | 206/221 |
| 4,274,550 | A * | 6/1981 | Feldstein | A61J 7/04 | 221/71 |

(Continued)

FOREIGN PATENT DOCUMENTS

| | | | | |
|---|---|---|---|---|
| FR | 2990605 | A1 * | 11/2013 | A41G 5/0086 |
| FR | 2990606 | A1 * | 11/2013 | |
| FR | 2990606 | A1 * | 11/2013 | A41G 5/02 |

OTHER PUBLICATIONS

PCT International Search Report; International Application No. PCT/US2014/024376; Completion Date: Jul. 23, 2014; Mailing Date: Jul. 24, 2014.

(Continued)

*Primary Examiner* — Rakesh Kumar

(74) *Attorney, Agent, or Firm* — Idris McKelvey

(57) ABSTRACT

An applicator for dispensing false eyelashes includes a supply wheel and a take-up wheel, the supply wheel comprising a tape having a plurality of pockets, where the pockets secure individual or clusters of false eyelashes until they are dispensed from a dispensing pivot. The spent tape is returned to the take-up wheel.

5 Claims, 6 Drawing Sheets

(56) References Cited

U.S. PATENT DOCUMENTS 4,576,311 A * 3/1986 Horton ..... A61L 9/12 118/235
4,891,090 A * 1/1990 Lorincz ..... B65H 37/007 156/577
5,125,589 A * 6/1992 Manusch ..... B65H 23/063 156/577
5,472,560 A * 12/1995 Horng ..... B65H 35/0033 156/523
5,579,669 A * 12/1996 Kind ..... A23G 3/563 242/588.6
5,729,963 A * 3/1998 Bird ..... B65B 9/04 53/453
6,021,919 A * 2/2000 Kelly ..... A61B 19/045 221/155
6,027,068 A * 2/2000 Lantsman ..... B23K 3/063 226/187
6,176,409 B1 * 1/2001 Lee ..... B65H 35/0026 156/510
6,206,072 B1 * 3/2001 Orihara ..... B65H 37/007 156/540
6,394,165 B1 * 5/2002 Rader ..... B65C 11/004 156/540
6,453,968 B1 * 9/2002 Hsu ..... B65H 35/0033 118/257
6,527,138 B2 * 3/2003 Pawlo ..... A61J 7/0409 221/26
6,845,883 B2 * 1/2005 Pieri ..... B65D 75/527 222/541.6
7,395,927 B2 * 7/2008 Wild ..... B65B 61/205 206/460
D577,771 S * 9/2008 Kouda ..... D19/69
7,611,016 B2 * 11/2009 Wihren ..... H05K 13/0084 206/519
8,322,262 B2 * 12/2012 Ryu ..... A23L 1/0067 221/30
8,616,223 B2 12/2013 Rabe et al.
8,720,521 B1 * 5/2014 Peary ..... B65H 35/0033 156/523
2003/0205332 A1 * 11/2003 Shinya ..... B65H 37/007 156/577
2005/0005934 A1 * 1/2005 Harvey ..... A61J 1/03 128/203.15
2006/0162248 A1 * 7/2006 Ahm ..... A01C 1/02 47/56
2006/0244558 A1 * 11/2006 Kinugasa ..... B65H 37/007 335/202
2009/0020133 A1 1/2009 Gueret
2012/0000957 A1 * 1/2012 Martinez ..... A41G 5/02 225/57
2013/0042884 A1 * 2/2013 Wilkinson ..... A41G 5/02 132/216
2014/0263392 A1 * 9/2014 Martins ..... B65D 83/0864 221/71
2014/0312050 A1 * 10/2014 Coggins ..... A61B 5/0408 221/71
2015/0020840 A1 * 1/2015 Rabe ..... A41G 5/02 132/216

OTHER PUBLICATIONS

PCT International Search Report; International Applicaton No. PCT/US2014/024425; Completion Date: Jul. 25, 2014; Mailing Date: Jul. 25, 2014.
PCT Written Opinion of the International Searching Authority; International Application No. PCT/US2014/024376; Completion Date: Jul. 23, 2014; Mailing Date: Jul. 24, 2014.
PCT Written Opinion of the International Searching Authority; International Application No. PCT/US2014/024425; Completion Date: Jul. 25, 2014; Mailing Date: Jul. 25, 2014.

* cited by examiner

FALSE EYELASH DISPENSER

CROSS-REFERENCE TO RELATED APPLICATIONS

The present application claims priority from U.S. Provisional Application No. 61/791,606, filed Mar. 15, 2013.

FIELD OF THE INVENTION

This invention relates to an apparatus for dispensing false eyelashes.

BACKGROUND OF THE INVENTION

False eyelashes must be purchased and applied for all types of eyelid shapes, sizes, eyelash colors, and a host of other factors. This level of customization has led to eyelashes that are quite expensive, and which are stored in bulky containers which are expensive to ship.

Another problem encountered with applying false eyelashes is handling and applying false eyelashes can be cumbersome, messy, and inaccurate. With current available products, applying false eyelashes takes skill and practice. One must use glue to adhere the false eyelashes to the eyelids. One must let the glue get the correct amount of "tackiness" and then apply without gumming up the eyelashes and ruining the product, or worse, damaging the eye itself. Although there are false eyelashes available with self-adhesive glue already on the lashes, these leave the glue residue on the real eyelashes and can result in removing the person's own lashes along with the false eyelashes.

Previous attempts to address these issues include false eyelash strips, which may include predetermined doses of adhesive. The strips are generally provided in predetermined lengths, which may not match the length of the eyelid to which they are applied. Also, the base of the strip of false lashes is readily visible, which reduces their natural appearance. False eyelash dispensers have been employed, which may include a cutting means for obtaining a more accurate length for application to the eyelid. But again, the base of the strip, or backbone, remains visible, and the device requires some skill on the part of the user to properly measure the strip before application. This creates a large margin for user error and does not overcome limits to the natural appearance of the false lashes.

To be applied effectively, and with a natural appearance, a false eyelash needs to be delivered to an eyelash or eyelid as individual lashes or lash clusters. The invention herein provides such lashes in a form-factor which enables easy application.

SUMMARY OF THE INVENTION

The present invention relates to an applicator for dispensing false eyelashes. It includes a supply wheel and a take-up wheel, the supply wheel comprising a tape having a plurality of pockets, where the pockets secure individual or clusters of false eyelashes until they are dispensed from a dispensing pivot for application to a user's eyelid or eyelashes. The spent tape is returned to the take-up wheel.

DETAILED DESCRIPTION OF THE INVENTION

The apparatus stores and delivers false eyelashes ("lashes on tape") conveniently in a manner that allows for easy and accurate application of false eyelashes that are dispensed individually or in false eyelash clusters. The false eyelashes are delivered perpendicularly to the user's eyelid or eyelash. As such, the invention comprises false eyelashes that are dispensed from tape, perpendicularly to the dispensing edge of the tape. The false eyelashes are dispensed from individual pockets on the tape, which obviate the necessity for an adhesive to hold the eyelashes onto the tape. This feature is important because adhesive residue on the surface of the eyelashes can create clumping and retain dust and debris when after the false eyelashes have been applied to the user's eyelid or eyelashes. Also, because the false eyelashes are dispensed from individual pockets rather than a single strip of false eyelashes, they can be stylized, curved, elongated, or otherwise differentiated from one another.

Common eyelash types include human hairs, synthetic hairs, nylon, fibers, threads, or even fiber optics. The tape is preferably medical-grade, fabric-covered tape. However, other types of tapes are functional equivalents, such as plastics. The false eyelashes should be treated, or pretreated, with an adhesive at their distal ends to facilitate application to a human eyelid or eyelash. Suitable adhesives include medical grade such as Elastoplast®, and are sufficiently tacky to secure the false eyelashes to the user's eyelashes or eyelid, but not so tacky as to harm the user.

Figure 1:
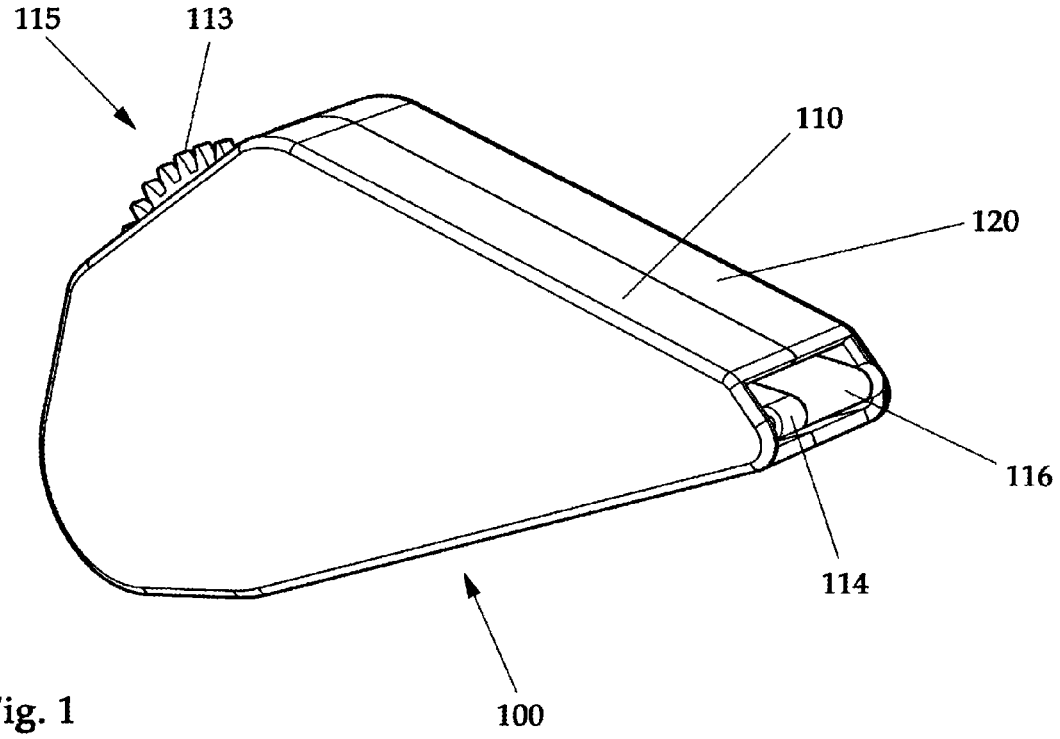
FIG. 1 is a perspective view of the apparatus.

FIG. 1 shows a perspective view of an apparatus 100 for dispensing false eyelashes. The apparatus 100 includes a casing defined by a first body 110 and a second body 120. The first and second bodies 110 and 120 are fastened to one another via any practical means such as screws, clips, bolts, and the like. To form a more consumer-acceptable casing, fasteners such as rivets, magnets, or other more easily-removable connections may be employed. The casing may include an opening between the bodies 110, and 120. The opening may extend around the perimeter of the casing, or the bodies 110 and 120 may be flush around their edges, while exposing an opening at the dispensing pivot 114. An actuating wheel 115 is generally positioned in the upper-intermediate portion of the casing and is provided to enable the dispensing motion of the tape 116. The dispensing pivot 114 is positioned such that an eyelash is dispensed from the tape 116 as it passes over the dispensing pivot 114. The casing is configured with an opening to facilitate dispensing at the dispensing pivot 114. The actuating wheel 115 may be formed with a textured surface such as cogs 113 to provide a surface for actuation by a user's finger, for example.

Figure 2:
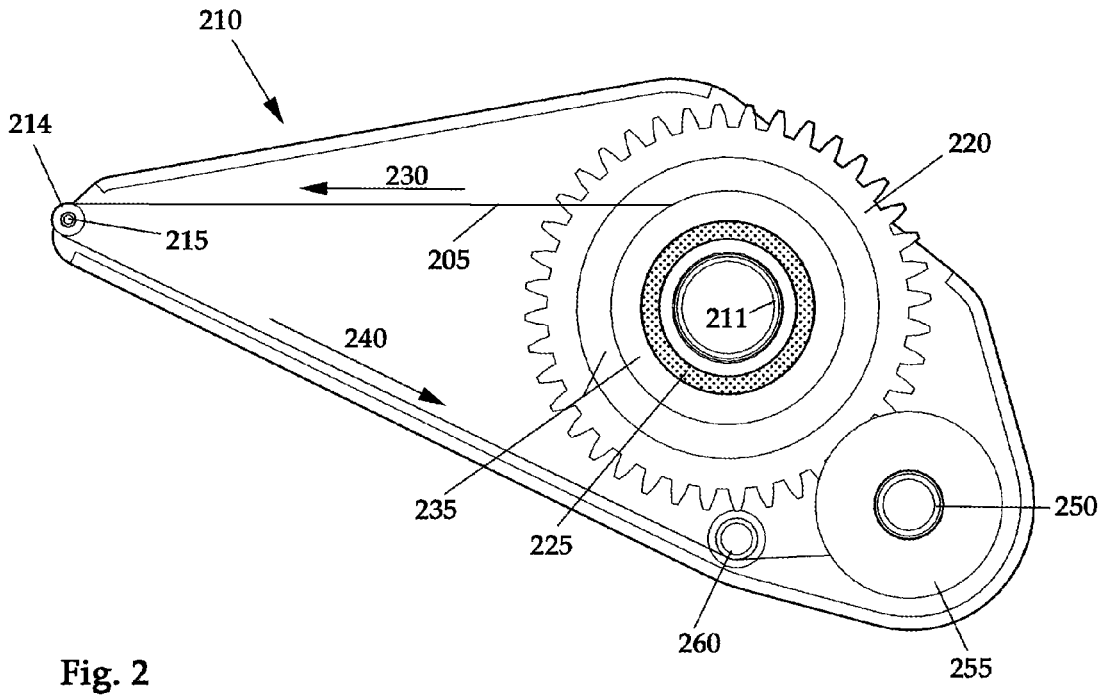
FIG. 2 is a side view of the apparatus with one second body removed.

FIG. 2 shows a side view of an embodiment of the false eyelash dispenser with the second body removed. In this embodiment, the first body 210 holds all of the components in position to facilitate the dispensing process. The actuating wheel 220 and supply wheel 235 sit on a dispensing cylinder 225, which in turn, sits on the dispensing axle 211. The actuating wheel 220 is provided to facilitate advancement of the tape 205 via the user's finger. The supply wheel 235 is provided to rotate, dispensing the tape 205, as the user pushes the actuating wheel 220 with a finger. In one embodiment, the actuating wheel 220 and supply wheel 235 may be formed together as one wheel. The take-up wheel 255 is placed on the rear axle 250 and is provided to receive spent tape 205 from the dispensing pivot 214.

The apparatus is operated by the user pushing the actuating wheel 220 forward. Several suitable actuation means known in the art are suitable, but most simply, the user pushes the wheel 220 forward with a finger. Through this action, the carrier tape 205 dispenses from the supply wheel 235 through a first run 230 and to the dispensing pivot 214. The dispensing pivot 214 is preferably a wheel which sits on the dispensing axle 215. The tape 205 bends around the dispensing pivot 214 and proceeds through a second run 240, past the other side of the supply wheel 235 to the take-up wheel 255. In order to guide the tape 205 through the second run 240 to the take-up wheel 255, an axle 260 may be provided intermediately.

Figure 3:
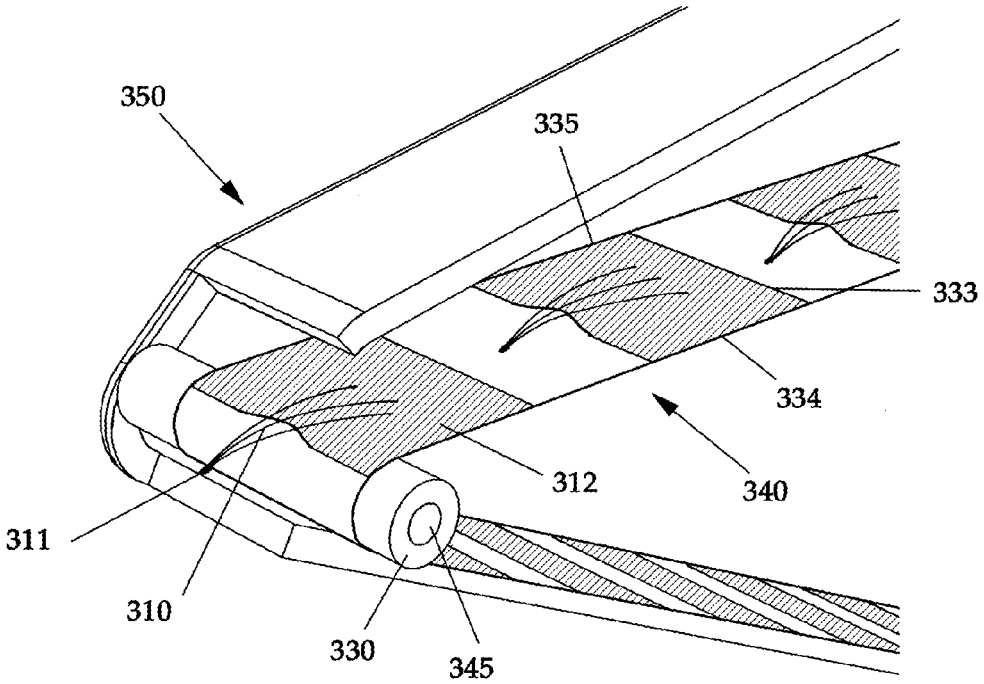
FIG. 3 is a close-up and cutout view of the apparatus' dispensing pivot.

FIG. 3 shows a cut-out view of the first body 350, showing the false eyelashes 310 being dispensed from the dispensing pivot 330. The dispensing pivot 330 fits over a dispensing axle 345, and it may comprise a simple curved surface for guiding the tape 340 as it is dispensed. More preferably, the dispensing pivot 330 is a wheel which provides a smooth pivot surface for the carrier tape 340. The pockets 312 are sealed, and preferably heat-sealed, to the carrier tape 340 surface at their lateral edges 334, 335. The anterior edge 333 of the carrier tape 340 may be sealed or unsealed relative to the carrier tape 340. When the anterior edge 333 remains unsealed, longer eyelashes 310 may be provided, which are held in place by threading through the pockets 312, and extending through the anterior edge 333. The pockets 312 secure the false eyelashes 310 to the carrier tape 340 until they are dispensed from the dispensing pivot 330. The false eyelash 310 is configured in the pockets 312 such that the distal end 311 of the false eyelashes 310 are directed towards the dispensing pivot 330. During use, the distal end 311 of the false eyelash 310 is exposed from the pocket 312 as it passes over the dispensing pivot 330. In one embodiment, the distal end 311 of the false eyelashes 310 are pretreated with an adhesive for applying the false eyelashes 310 to the user's eyelid or eyelashes. In another embodiment, the distal end 311 of the false eyelashes 310 is treated with an adhesive just before applying the false eyelashes 310 to the user's eyelid or eyelash.

Figure 4:
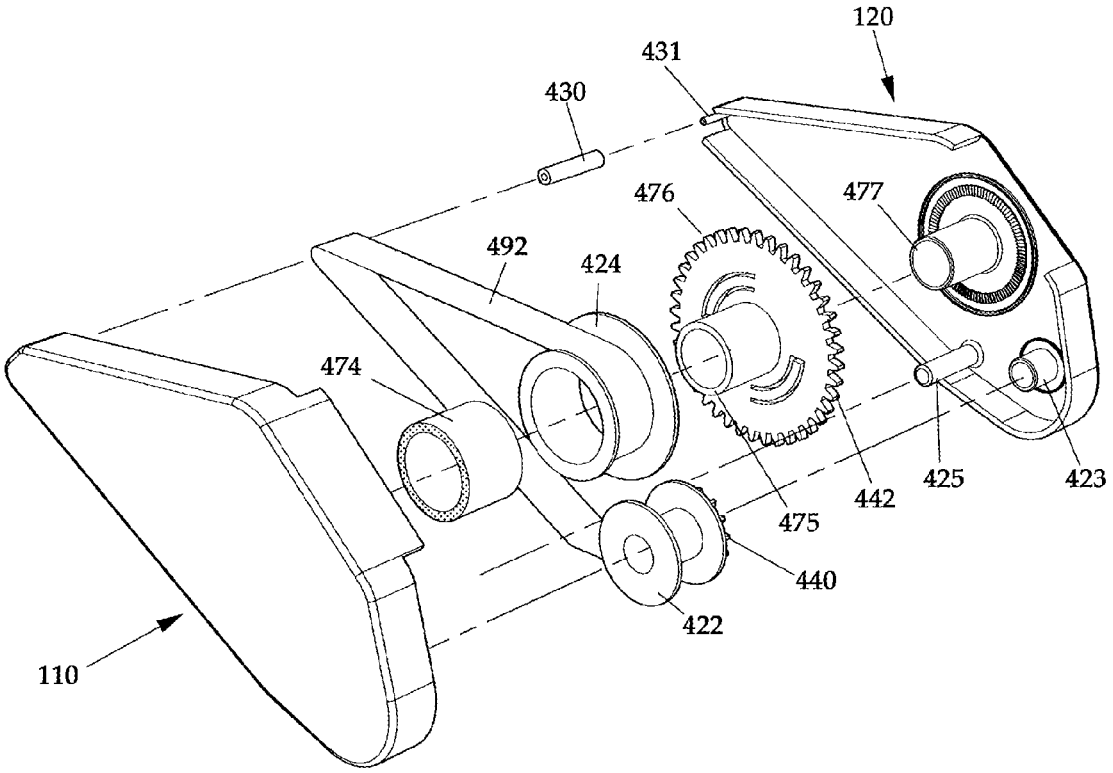
FIG. 4 is an exploded view of the components of the apparatus.

FIG. 4 is an exploded view of an embodiment depicting the take-up wheel 422 and the supply wheel 424, fitted with the tape 492 which is suitable for holding false eyelashes, extending from the supply wheel 424, over the dispensing pivot 430, to the take-up wheel 422. The supply wheel 424 fits over the dispensing cylinder 474, and the dispensing cylinder 474 fits over the center cylinder 475 of the actuating wheel 476. The dispensing cylinder 474 is generally formed from rubber or a similar material which provides sufficient friction to effectively drive the supply wheel 424 when the actuating wheel 476 is rotated by the user. Providing the dispensing cylinder 474 allows for relatively simple replacement of the tape 492 and/or supply wheel 424 for refilling purposes. When fully assembled, the components engage with the axles 431, 477, 425, and 423. Specifically, the dispensing pivot 430 fits over the dispensing axle 431, the actuating axle 477 fits inside of the center cylinder 475 of the actuating wheel 476. The axle 425 at the rear of the first body 120, but preceding the take-up axle 423, is provided to assist in guiding the tape 492 to the take-up wheel 422 as the tape 492 is dispensed. The take-up wheel 422 fits over the take-up axle 423. The take-up wheel 422 may comprise cogs 440 which intermesh with cogs 442 on the actuating wheel 476 to coordinate the dispensing and take-up action of the tape 492. Each respective axle in the first body 120 engages a matching receptacle on the inside surface of the second body 110 to encourage structural stability of the apparatus.

To load the tape 492 into the apparatus, a role of tape 492 is provided on a supply wheel 424, which is preloaded with false eyelashes. The tape is extended over the dispensing pivot 430 and rear axle 425, then connected to the take-up wheel 422. The tape 492 may be secured to the take-up wheel 422 by various means. Preferably, a sufficient portion of the tape 492 is pretreated with an adhesive material to effectively adhere the tape 492 to the take-up wheel 422.

Figure 5:
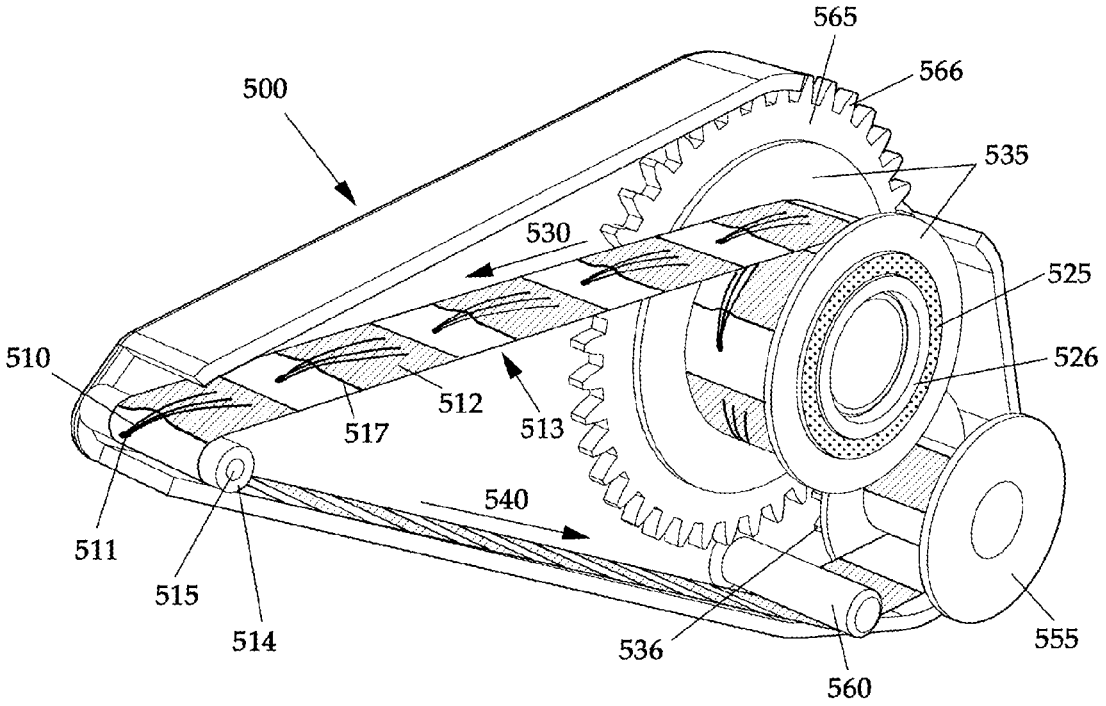
FIG. 5 is an isometric view of the apparatus, with the second body removed.

FIG. 5 shows a side perspective view of an embodiment of the false eyelash dispenser with the second body removed. The first body 500 is the place holder that holds all of the components in position so that the dispensing process can be performed properly. The actuating wheel 565 is placed on the actuating axle 526. The actuating wheel 565, is engaged with a dispensing cylinder 525, which in turn is engaged with the supply wheel 535. The actuating wheel 565 comprises a series of cogs 566, which engage with complimentary cogs 536 on the take-up wheel 555. When operated by a user, the cogs 566 on the actuating wheel 565 engage the cogs 536 on the take-up wheel 555, causing the supply wheel 535 and take-up wheel 555 to move in concert as the tape 513 is dispensed. The eyelashes 510 are arranged such that the distal ends 511 of the false eyelashes 510 protrude from the distal side 517 of the pockets 512. When actuated, the tape 513 moves along its first run 530, and the distal end 511 of the lash 510 is presented over the pivot wheel 514 for a user to apply to her eyelid or eyelash. The pivot wheel 514 is preferably a wheel which rotates around a pivot axle 515. And a rear axle 560 is provided to guide the tape 513 through a second run 540 to the take-up wheel 555. In one embodiment, the distal end 511 of the false eyelashes 510 are treated with a user-acceptable adhesive just prior to application to the eyelid or eyelash.

Figure 6:
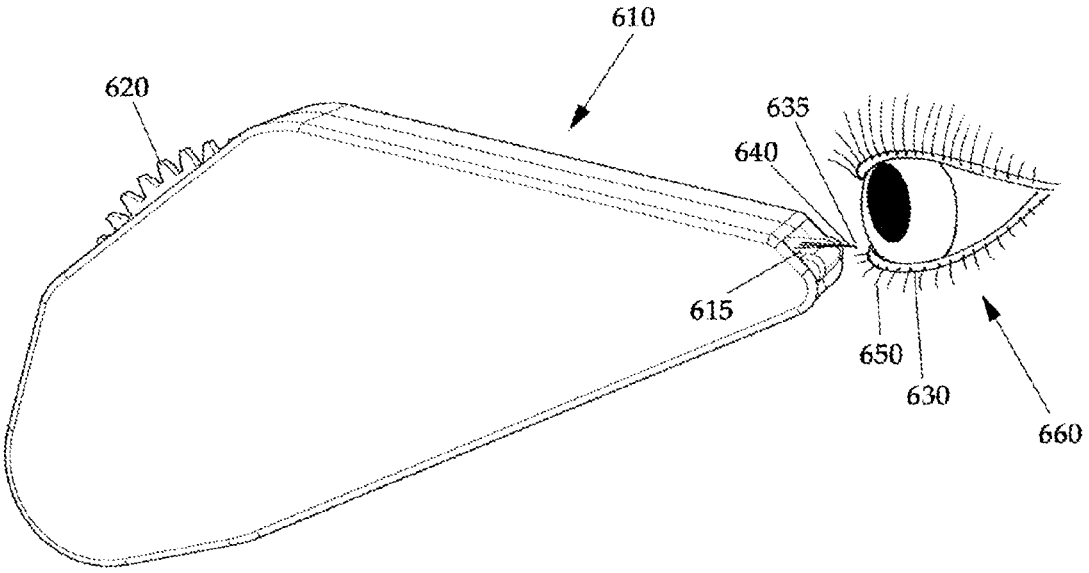
FIG. 6 is a representation of the apparatus as it dispenses false eyelashes to a user.

FIG. 6 shows the apparatus 610, in use, as a user applies a false eyelash 640 to her own eyelash 650. As depicted, the actuating wheel 620 has been pushed along its rotational axis sufficiently to expose a false eyelash 640. The distal end 635 of the false eyelash 640 is then applied to the user's eyelash 650. The distal end 635 of the false eyelash 640 is pretreated with a user-acceptable adhesive to affix the false eyelash 640 to the user's eyelash 650. Suitable eyelash adhesives are commercially available from, for example, DUO®. The adhesive may be provided commercially as a kit, with the dispensing apparatus 610. In another embodiment, the false eyelash 640 may be blended into the user's existing natural eyelashes 650 by applying the distal end 635 of the false eyelashes 640 to the user's eyelid 630. As the false eyelash 640 is applied to the eyelash 650 or eyelid 630, the user is instructed to apply light pressure to the distal end 635 of the false eyelash 640 at the application site for a period of time. Once the adhesive adheres to the application site, the user should pull the apparatus 610 away from the eye 660. The eyelash 640 will remain on the application site and slide out from the pocket 615. This process is repeated until the desired cosmetic appearance is achieved.

The apparatus herein may be preloaded with false eyelashes of varying lengths, shapes, and orientations to achieve a variety of cosmetic effects. In one embodiment, the apparatus is preloaded with a predetermined number of short, medium, and long false eyelashes. The apparatus may also include instructions or depict a template for applying the false eyelashes of varying lengths to achieve a particular cosmetic effect. Preloading the apparatus with such false eyelashes, and providing instructions for their application, improves the overall user experience as compared to currently known approaches for applying false eyelashes. Specifically, the predetermined assortment of lashes in each apparatus allows the user to select a particular apparatus based on a specifically desired cosmetic appearance at the point of sale. For example, the first ten pockets may consist of short false eyelashes, the next ten may consist of medium eyelashes, and the next ten may consist of long eyelashes. Of course, any predetermined ratio of short, medium, and long eyelashes may be employed.

What is claimed is:

1. An apparatus for dispensing false eyelashes comprising a casing, the casing comprising an opening for dispensing false eyelashes, a supply wheel, a dispensing pivot, a take-up wheel for spent tape, the supply wheel carrying a supply roll of carrier tape and comprising a plurality of pockets, each of said pockets comprising at least one false eyelash to be dispensed, and said eyelashes being configured in said pockets such that distal ends of each false eyelash is directed towards the dispensing pivot with the distal end of said false eyelash being exposed from said pocket, the take-up wheel receives spent tape after each false eyelash is dispensed at the dispensing pivot, the carrier tape extending from a first side of the supply roll, through a first run to the dispensing pivot, around the dispensing pivot such that the distal end of the eyelash is exposed for application, through a second run to said take-up wheel, and a dispensing actuator wheel is provided to drive rotation of the supply wheel, an actuator protruding from an opening in an upper portion of said casing.

2. An apparatus according to claim 1, wherein said actuator wheel and said take-up wheel each comprise a circumferential cogging, said respective cogging engaging with one another to facilitate said actuator wheel and said take-up wheel moving in concert.

3. An apparatus according to claim 1, wherein the actuator is a wheel which is coaxially coupled to said supply wheel.

4. An apparatus according to claim 1, wherein said apparatus comprises false eyelashes of various lengths.

5. An apparatus according to claim 4, wherein said false eyelashes are comprised in a predetermined ratio of short, medium, and long false eyelashes.

* * * * *